US010890329B2

(12) United States Patent
Boardman et al.

(10) Patent No.: US 10,890,329 B2
(45) Date of Patent: Jan. 12, 2021

(54) FUEL INJECTOR ASSEMBLY FOR GAS TURBINE ENGINE

(71) Applicant: General Electric Company, Schenectady, NY (US)

(72) Inventors: Gregory Allen Boardman, Liberty Township, OH (US); Pradeep Naik, Bangalore (IN); Jacob Foster, Bethel, OH (US); Kediya Vishal Sanjay, Maharashtra (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 71 days.

(21) Appl. No.: 15/909,211

(22) Filed: Mar. 1, 2018

(65) Prior Publication Data

US 2019/0271470 A1 Sep. 5, 2019

(51) Int. Cl.
*F23R 3/28* (2006.01)
*F23D 14/64* (2006.01)

(52) U.S. Cl.
CPC ..... *F23R 3/286* (2013.01); *F23D 14/64* (2013.01); *F23R 3/283* (2013.01)

(58) Field of Classification Search
CPC ..... F23D 14/64; F23R 3/343; F23R 3/283; F23R 3/286; F23R 2900/03343
See application file for complete search history.

(56) References Cited

U.S. PATENT DOCUMENTS 2,565,843 A 8/1951 Dennison
3,917,173 A 11/1975 Singh
3,946,552 A 3/1976 Weinstein et al.
3,972,182 A 8/1976 Salvi
3,980,233 A 9/1976 Simmons et al.
4,100,733 A 7/1978 Striebel et al.
4,177,637 A 12/1979 Pask
4,215,535 A 8/1980 Lewis
4,222,232 A 9/1980 Robinson
4,226,083 A 10/1980 Lewis et al.
(Continued)

FOREIGN PATENT DOCUMENTS

CN 104870895 A 8/2015
CN 105829802 A 8/2016
EP 1319896 A2 6/2003

OTHER PUBLICATIONS

U.S. Appl. No. 15/343,601, filed Nov. 4, 2016.
(Continued)

*Primary Examiner* — Scott J Walthour
(74) *Attorney, Agent, or Firm* — Dority & Manning, P.A.

(57) ABSTRACT

The present disclosure is directed to a fuel injector including a centerbody defining an air inlet opening defined substantially radially through the centerbody; an outer sleeve surrounding the centerbody, and an end wall coupled to the centerbody and the outer sleeve. The outer sleeve defines a radially oriented first air inlet port defined radially outward of the air inlet opening at the centerbody. A mixing passage is defined between the outer sleeve and the centerbody. A first fuel injection port is defined substantially axially through the end wall to the mixing passage. The first fuel injection port defines a first fuel injection opening at the mixing passage between the first air inlet port at the outer sleeve and the air inlet opening at the centerbody.

18 Claims, 7 Drawing Sheets

(56) References Cited

U.S. PATENT DOCUMENTS 4,262,482 A 4/1981 Roffe et al.
4,408,461 A 10/1983 Bruhwiler et al.
4,412,414 A 11/1983 Novick et al.
4,689,961 A 9/1987 Stratton
4,763,481 A 8/1988 Cannon
4,967,561 A 11/1990 Bruhwiler et al.
5,121,597 A 6/1992 Umshidani et al.
5,207,064 A 5/1993 Ciokajlo et al.
5,211,675 A 5/1993 Bardey et al.
5,235,814 A 8/1993 Leonard
5,251,447 A 10/1993 Joshi et al.
5,263,325 A 11/1993 McVey et al.
5,265,409 A 11/1993 Smith, Jr. et al.
5,307,634 A 5/1994 Hu
5,339,635 A 8/1994 Iwai et al.
5,351,477 A 10/1994 Joshi et al.
5,373,693 A 12/1994 Zarzalis et al.
5,511,375 A 4/1996 Joshi et al.
5,592,821 A 1/1997 Alary et al.
5,619,855 A 4/1997 Burrus
5,622,054 A 4/1997 Tingle
5,675,971 A * 10/1997 Angel ..... F23R 3/286 239/405
5,791,137 A 8/1998 Evans et al.
5,816,049 A 10/1998 Joshi
5,829,967 A 11/1998 Chyou
5,839,283 A 11/1998 Dobbeling
5,862,668 A 1/1999 Richardson
5,881,756 A 3/1999 Abbasi et al.
5,937,653 A 8/1999 Alary et al.
6,016,658 A 1/2000 Willis et al.
6,038,861 A 3/2000 Amos et al.
6,158,223 A 12/2000 Mandai et al.
6,272,840 B1 8/2001 Crocker et al.
6,286,298 B1 9/2001 Burrus et al.
6,295,801 B1 10/2001 Burrus et al.
6,331,109 B1 12/2001 Paikert et al.
6,367,262 B1 4/2002 Mongia et al.
6,442,939 B1 9/2002 Stuttaford et al.
6,460,339 B2 10/2002 Nishida et al.
6,539,721 B2 4/2003 Oikawa et al.
6,539,724 B2 4/2003 Cornwell et al.
6,543,235 B1 4/2003 Crocker et al.
6,564,555 B2 5/2003 Rice et al.
6,594,999 B2 7/2003 Mandai et al.
6,598,584 B2 7/2003 Beck et al.
6,609,376 B2 8/2003 Rokke
6,662,564 B2 12/2003 Bruck et al.
6,742,338 B2 6/2004 Tanaka et al.
6,772,594 B2 8/2004 Nishida et al.
6,837,050 B2 1/2005 Mandai et al.
6,837,051 B2 1/2005 Mandai et al.
6,915,637 B2 7/2005 Nishida et al.
6,962,055 B2 11/2005 Chen et al.
7,036,482 B2 5/2006 Beck et al.
7,117,677 B2 10/2006 Inoue et al.
7,188,476 B2 3/2007 Inoue et al.
7,200,998 B2 4/2007 Inoue et al.
7,284,378 B2 10/2007 Amond, III et al.
7,313,919 B2 1/2008 Inoue et al.
7,343,745 B2 3/2008 Inoue et al.
7,360,363 B2 4/2008 Mandai et al.
7,434,401 B2 10/2008 Hayashi
7,469,544 B2 12/2008 Farhangi
7,516,607 B2 4/2009 Farhangi et al.
7,565,803 B2 7/2009 Li et al.
7,610,759 B2 11/2009 Yoshida et al.
7,677,026 B2 3/2010 Conete et al.
7,762,074 B2 7/2010 Bland et al.
7,770,397 B2 8/2010 Patel et al.
7,788,929 B2 9/2010 Biebel et al.
7,810,333 B2 10/2010 Kraemer et al.
7,841,180 B2 11/2010 Kraemer et al.
7,871,262 B2 1/2011 Carroni et al.
7,966,801 B2 6/2011 Umeh et al.
8,033,112 B2 10/2011 Milosavljevic et al.
8,033,821 B2 10/2011 Eroglu
8,057,224 B2 11/2011 Knoepfel
8,161,751 B2 4/2012 Hall
8,225,591 B2 7/2012 Johnson et al.
8,225,613 B2 7/2012 Sisco et al.
8,234,871 B2 8/2012 Davis, Jr. et al.
8,276,385 B2 10/2012 Zuo et al.
8,316,644 B2 11/2012 Wilbraham
8,322,143 B2 12/2012 Uhm et al.
8,347,630 B2 1/2013 Lovett et al.
8,375,721 B2 2/2013 Wilbraham
8,424,311 B2 4/2013 York et al.
8,438,851 B1 5/2013 Uhm et al.
8,511,087 B2 8/2013 Fox et al.
8,528,337 B2 9/2013 Berry et al.
8,539,773 B2 9/2013 Ziminsky et al.
8,550,809 B2 10/2013 Uhm et al.
8,590,311 B2 11/2013 Parsania et al.
8,621,870 B2 1/2014 Carroni et al.
8,671,691 B2 3/2014 Boardman et al.
8,683,804 B2 4/2014 Boardman et al.
8,701,417 B2 4/2014 Nicholls et al.
8,752,386 B2 6/2014 Fox et al.
8,850,820 B2 10/2014 Milosavljevic et al.
8,863,524 B2 10/2014 Karlsson et al.
8,938,971 B2 1/2015 Poyyapakkam et al.
8,943,835 B2 2/2015 Corsmeier et al.
9,091,444 B2 7/2015 Turrini et al.
9,134,023 B2 9/2015 Boardman et al.
9,182,123 B2 11/2015 Boardman et al.
9,335,050 B2 5/2016 Cunha et al.
9,377,192 B2 6/2016 Hirata et al.
9,388,985 B2 7/2016 Wu et al.
9,416,973 B2 8/2016 Melton et al.
9,423,137 B2 8/2016 Nickolaus
9,810,152 B2 11/2017 Genin et al.
10,101,025 B2 10/2018 Berhaut et al.
10,190,774 B2 1/2019 Mook et al.
2002/0083711 A1 7/2002 Dean et al.
2003/0101729 A1 6/2003 Srinivasan
2006/0021350 A1 2/2006 Sanders
2007/0099142 A1 5/2007 Flohr et al.
2007/0227148 A1 10/2007 Bland et al.
2007/0259296 A1 11/2007 Knoepfel
2008/0083229 A1 4/2008 Haynes et al.
2008/0280239 A1 11/2008 Carroni et al.
2009/0173075 A1 7/2009 Miura et al.
2009/0293484 A1 12/2009 Inoue et al.
2010/0083663 A1 4/2010 Fernandes et al.
2010/0186412 A1 7/2010 Stevenson et al.
2010/0236247 A1 9/2010 Davis, Jr. et al.
2010/0275601 A1 11/2010 Berry et al.
2011/0000215 A1 1/2011 Lacy et al.
2011/0016866 A1 1/2011 Boardman et al.
2011/0016871 A1 1/2011 Kraemer et al.
2011/0083439 A1 4/2011 Zuo et al.
2011/0252803 A1 10/2011 Subramanian et al.
2011/0265482 A1 11/2011 Parsania et al.
2011/0289933 A1 12/2011 Boardman et al.
2012/0096866 A1 4/2012 Khan et al.
2012/0131923 A1 5/2012 Elkady et al.
2012/0279223 A1 11/2012 Barker et al.
2012/0285173 A1 11/2012 Poyyapakkam et al.
2013/0042625 A1 2/2013 Barker et al.
2013/0074510 A1 3/2013 Berry
2013/0101729 A1 4/2013 Keremes et al.
2013/0101943 A1 4/2013 Uhm et al.
2013/0177858 A1 7/2013 Boardman et al.
2013/0199188 A1 8/2013 Boardman et al.
2013/0239581 A1 9/2013 Johnson et al.
2013/0318977 A1 12/2013 Berry et al.
2013/0336759 A1 12/2013 Christians
2014/0033718 A1 2/2014 Manoharan et al.
2014/0053571 A1 2/2014 Keener et al.
2014/0060060 A1 3/2014 Bernero et al.
2014/0096502 A1 4/2014 Karlsson et al.
2014/0290258 A1 10/2014 Gerendas et al.
2015/0076251 A1 3/2015 Berry

(56) References Cited

U.S. PATENT DOCUMENTS

| | | | | |
|---|---|---|---|---|
| 2015/0128607 | A1 | 5/2015 | Lee | |
| 2015/0159875 | A1 | 6/2015 | Berry et al. | |
| 2016/0010856 | A1 | 1/2016 | Biagioli et al. | |
| 2016/0169110 | A1 | 6/2016 | Myers et al. | |
| 2016/0209036 | A1 | 7/2016 | Cheung | |
| 2016/0290650 | A1 | 10/2016 | Abd El-Nabi et al. | |
| 2017/0306781 | A1* | 10/2017 | Lewis | F01D 5/02 |
| 2017/0350598 | A1 | 12/2017 | Boardman et al. | |

OTHER PUBLICATIONS

U.S. Appl. No. 15/343,746, filed Nov. 4, 2016.
U.S. Appl. No. 15/343,672, filed Nov. 4, 2016.
Srinivasan et al., "Improving low load combustion, stability, and emissions in pilot-ignited natural gas engines", Journal of Automobile Engineering, Sage journals, vol. 220, No. 2, pp. 229-239, Feb. 1, 2006.
Snyder et al., "Emission and Performance of a Lean-Premixed Gas Fuel Injection System for Aeroderivative Gas Turbine Engines", Journal of Engineering for Gas Turbines and Power, ASME Digital Collection, vol. 118, Issue 1, pp. 38-45, Jan. 1, 1996.
Great Britain Office Action Corresponding to Application No. 1902680 dated Sep. 16, 2019.
Combined Chinese Office Action and Search Report Corresponding to Application No. 201910155253 dated Mar. 26, 2020.

* cited by examiner

FUEL INJECTOR ASSEMBLY FOR GAS TURBINE ENGINE

FIELD

The present subject matter relates generally to gas turbine engine combustion assemblies. More particularly, the present subject matter relates to a premixing fuel nozzle assembly for gas turbine engine combustors.

BACKGROUND

Aircraft and industrial gas turbine engines include a combustor in which fuel is burned to input energy to the engine cycle. Typical combustors incorporate one or more fuel nozzles whose function is to introduce liquid or gaseous fuel into an air flow stream so that it can atomize and burn. General gas turbine engine combustion design criteria include optimizing the mixture and combustion of a fuel and air to produce high-energy combustion while minimizing emissions such as carbon monoxide, carbon dioxide, nitrous oxides, and unburned hydrocarbons, as well as minimizing combustion tones due, in part, to pressure oscillations during combustion.

However, general gas turbine engine combustion design criteria often produce conflicting and adverse results that must be resolved. For example, a known solution to produce higher-energy combustion is to incorporate an axially oriented vane, or swirler, in serial combination with a fuel injector to improve fuel-air mixing and atomization. However, such a serial combination may produce large combustion swirls or longer flames that may increase primary combustion zone residence time or create longer flames. Such combustion swirls may induce combustion instability, such as increased acoustic pressure dynamics or oscillations (i.e. combustion tones), increased lean blow-out (LBO) risk, or increased noise, or inducing circumferentially localized hot spots (i.e. circumferentially asymmetric temperature profile that may damage a downstream turbine section), or induce structural damage to a combustion section or overall gas turbine engine.

Additionally, larger combustion swirls or longer flames may increase the length of a combustor section. Increasing the length of the combustor generally increases the length of a gas turbine engine or removes design space for other components of a gas turbine engine. Such increases in gas turbine engine length are generally adverse to general gas turbine engine design criteria, such as by increasing weight and packaging of aircraft gas turbine engines and thereby reducing gas turbine engine fuel efficiency and performance.

Therefore, a need exists for a fuel injector assembly that may produce high-energy combustion while minimizing emissions, combustion instability, structural wear and performance degradation, while maintaining or decreasing combustor size.

BRIEF DESCRIPTION

Aspects and advantages of the invention will be set forth in part in the following description, or may be obvious from the description, or may be learned through practice of the invention.

The present disclosure is directed to a fuel injector including a centerbody defining an air inlet opening defined substantially radially through the centerbody; an outer sleeve surrounding the centerbody, and an end wall coupled to the centerbody and the outer sleeve. The outer sleeve defines a radially oriented first air inlet port defined radially outward of the air inlet opening at the centerbody. A mixing passage is defined between the outer sleeve and the centerbody. A first fuel injection port is defined substantially axially through the end wall to the mixing passage. The first fuel injection port defines a first fuel injection opening at the mixing passage between the first air inlet port at the outer sleeve and the air inlet opening at the centerbody.

In various embodiments, the centerbody defines a substantially hollow cooling cavity, and wherein a flow of oxidizer is permitted to flow therethrough. In one embodiment, the centerbody defines a first inner radial wall extended radially within the centerbody. The first inner radial wall defines an impingement opening therethrough to permit the flow of oxidizer through the first inner radial wall. In still various embodiments, the centerbody defines a second inner radial wall extended radially within the centerbody. The second inner radial wall defines a cooling opening therethrough. In one embodiment, the second inner radial wall is defined protruded along an axial direction toward an upstream end of the fuel injector.

In various embodiments, the end wall defines a first forward face. The first forward face defines an acute angle from a downstream end to an upstream end. In one embodiment, the first forward face is further defined at least partially through the air inlet opening through the centerbody. In another embodiment, the first forward face and the air inlet opening together define an acute angle between approximately 15 degrees and approximately 85 degrees relative to a fuel injector centerline.

In still various embodiments, the outer sleeve further defines a second air inlet port upstream of the first air inlet port. In one embodiment, the second air inlet port is disposed circumferentially between a plurality of first fuel injection ports defined in adjacent circumferential arrangement through the end wall.

In one embodiment, the outer sleeve is coupled to an aft wall defining a groove substantially concentric to a fuel injector centerline.

In various embodiments, a second fuel injection port is defined through the end wall radially inward of the first fuel injection port. The second fuel injection port is defined substantially axially through the end wall to the mixing passage. In one embodiment, the second fuel injection port is defined radially between the first fuel injection port and the air inlet opening. In another embodiment, the second fuel injection port is defined radially inward of the first fuel injection port.

In still various embodiments, the end wall further defines a second forward face defined at least partially through the first air inlet port through the outer sleeve. In one embodiment, the second forward face and the first air inlet port together define an acute angle between approximately 95 degrees and approximately 165 degrees relative to a fuel injector centerline.

In one embodiment, a variable fillet is defined from a forward end to an aft end within one or more of the first air inlet port, the second air inlet port, or the air inlet opening.

In another embodiment, the first air inlet port is defined through the outer sleeve substantially in circumferential alignment with the first fuel injection opening.

In various embodiments, the end wall further defines a substantially conical portion surrounding each first fuel injection port. In one embodiment, the conical portion of the end wall further surrounds a second fuel injection port defined through the end wall.

In one embodiment, the outer sleeve further defines an air cavity disposed radially outward of the first fuel injection port.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
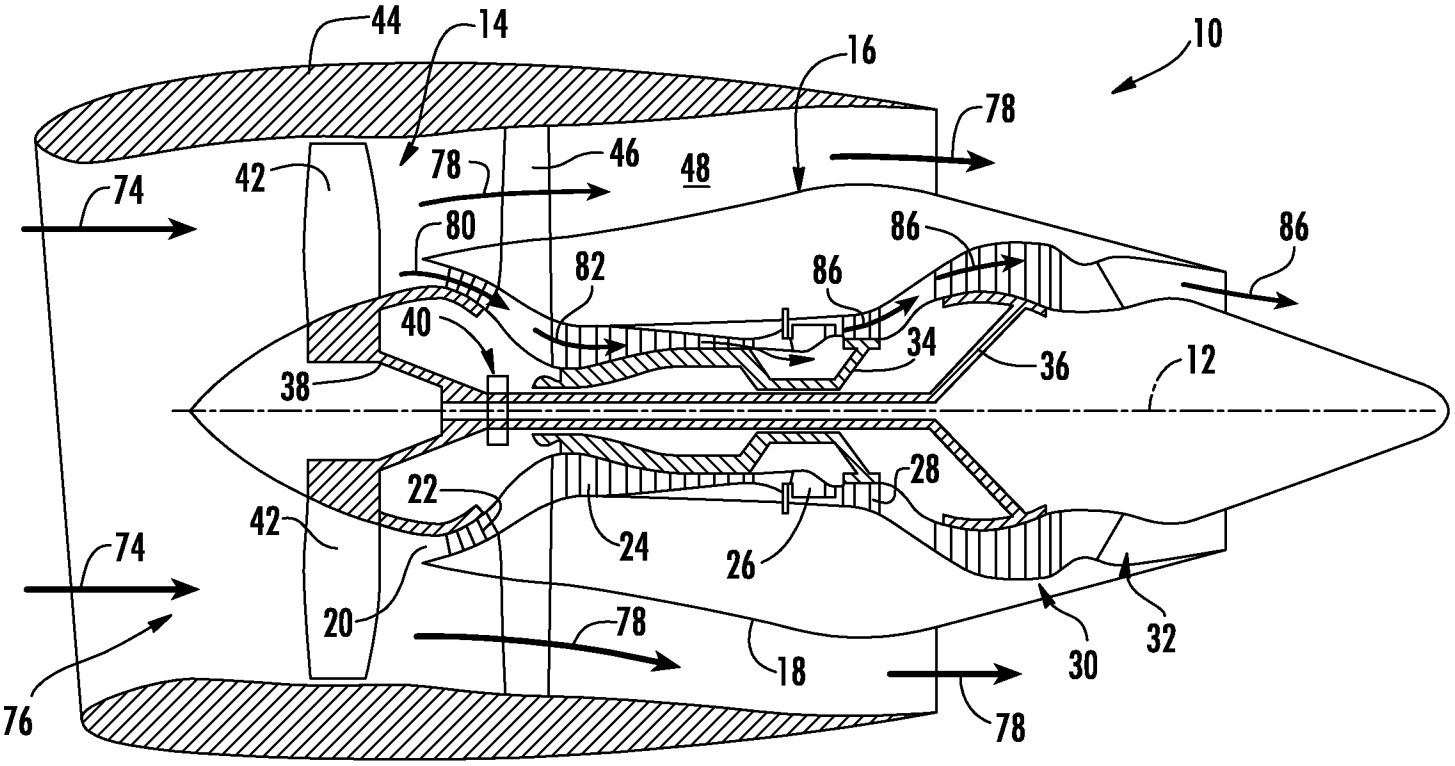
FIG. 1 is a schematic cross sectional view of an exemplary gas turbine engine incorporating an exemplary embodiment of a fuel injector and fuel nozzle assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Air and oxidizer, as used herein, may be interchangeably used to include air or any other oxidizer appropriate for mixing and burning with a liquid or gaseous fuel.

Embodiments of an opposing jet air blast atomizing fuel injector assembly for a gas turbine engine are generally provided that may produce high-energy combustion while minimizing emissions, combustion tones, structural wear and performance degradation, while maintaining or decreasing combustor size. In one embodiment, a first fuel injection port disposed radially between a first air inlet port and an air inlet opening produces high turbulence of a flow of air mixing with a liquid and/or gaseous fuel. Additionally, disposing the first fuel injection port radially between the first air inlet port and air inlet opening helps to keep the fuel in the center of a fuel-oxidizer mixing passage, thereby preventing wetting of the surrounding walls of the outer sleeve and centerbody.

The plurality of the fuel injectors defining a fuel nozzle assembly for the gas turbine engine may provide a compact, non-swirl or low-swirl premixed flame at a higher primary combustion zone temperature producing a higher energy combustion with a shorter flame length while maintaining or reducing emissions outputs. Additionally, the non-swirl or low-swirl premixed flame may mitigate combustor instability (e.g. combustion tones, LBO, hot spots) that may be caused by a breakdown or unsteadiness in a larger flame.

In particular embodiments, the plurality of fuel injectors included with the fuel nozzle assembly may provide finer combustion dynamics controllability across a circumferential profile of the combustor assembly as well as a radial profile. Combustion dynamics controllability over the circumferential and radial profiles of the combustor assembly may reduce or eliminate hot spots (i.e. provide a more even thermal profile across the circumference of the combustor assembly) that may increase combustor and turbine section structural life.

Referring now to the drawings, FIG. 1 is a schematic partially cross-sectioned side view of an exemplary high by-pass turbofan jet engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial centerline axis 12 that extends there through for reference purposes. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
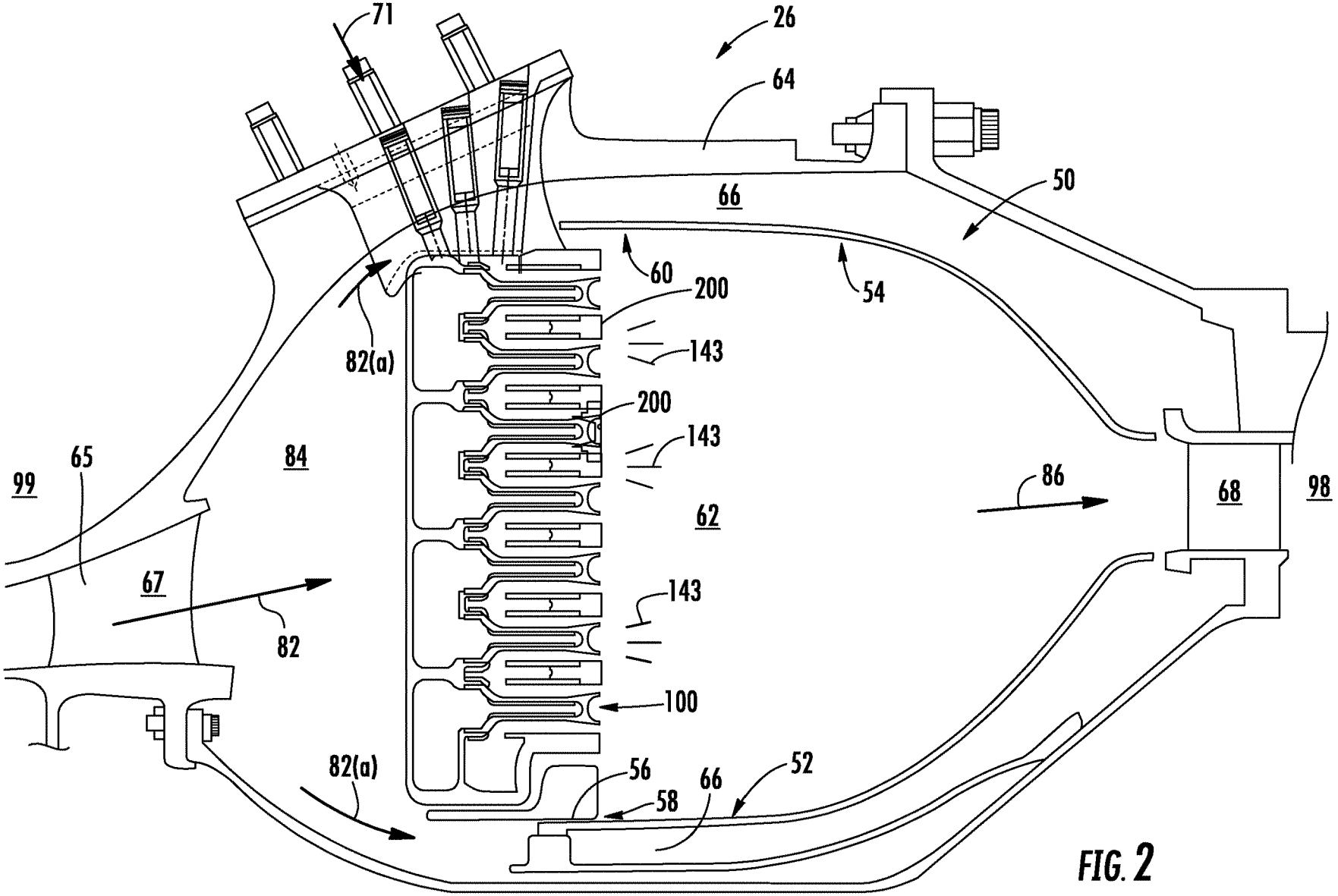
FIG. 2 is an axial cross sectional view of an exemplary embodiment of a combustor assembly of the exemplary engine shown in FIG. 1.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a bulkhead 56 that extends radially between upstream ends 58, 60 of the inner liner 52 and the outer liner 54 respectfully. In other embodiments of the combustion section 26, the combustion assembly 50 may be a can or can-annular type. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within an outer casing 64. An outer flow passage 66 may be defined around the inner liner 52 and/or the outer liner 54. The inner liner 52 and the outer liner 54 may extend from the bulkhead 56 towards a turbine nozzle or inlet 68 to the HP turbine 28 (FIG. 1), thus at least partially defining a hot gas path between the combustor assembly 50 and the HP turbine 28. A fuel nozzle 200 may extend at least partially through the bulkhead 56 and provide a fuel-air mixture 143 to the combustion chamber 62.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 and through a prediffuser 65 into a diffuser cavity or head end portion 84 of the combustion section 26.

The prediffuser 65 and CEGV 67 condition the flow of compressed air 82 to the fuel nozzle 200. The compressed air 82 pressurizes the diffuser cavity 84. The compressed air 82 enters the fuel nozzle 200 and into a plurality of fuel injectors 100 within the fuel nozzle 200 to mix with a fuel 71. The fuel injectors 100 premix fuel 71 and air 82 within the array of fuel injectors with little or no swirl to the resulting fuel-air mixture 143 exiting the fuel nozzle 200. After premixing the fuel 71 and air 82 within the fuel injectors 100, the fuel-air mixture 143 burns from each of the plurality of fuel injectors 100 as an array of compact, tubular flames stabilized from each fuel injector 100.

Typically, the LP and HP compressors 22, 24 provide more compressed air to the diffuser cavity 84 than is needed for combustion. Therefore, a second portion of the compressed air 82 as indicated schematically by arrows 82(*a*) may be used for various purposes other than combustion. For example, as shown in FIG. 2, compressed air 82(*a*) may be routed into the outer flow passage 66 to provide cooling to the inner and outer liners 52, 54. In addition or in the alternative, at least a portion of compressed air 82(*a*) may be routed out of the diffuser cavity 84. For example, a portion of compressed air 82(*a*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Figure 3:
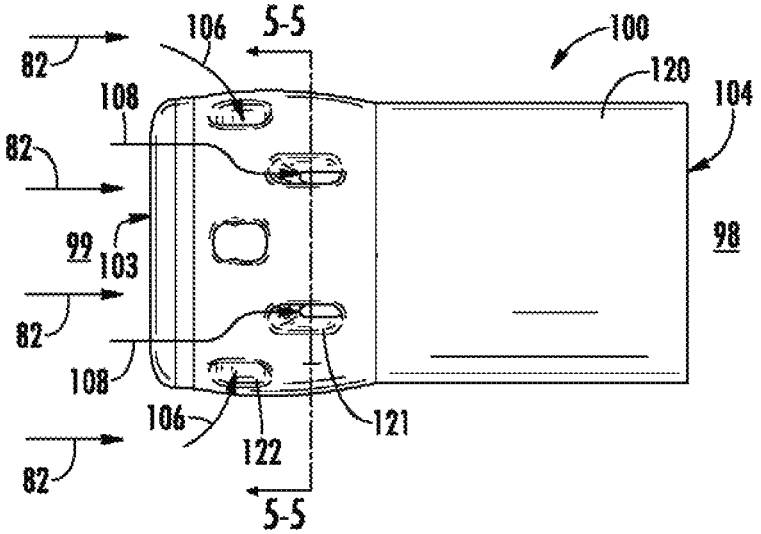
FIG. 3 is a perspective view of an exemplary embodiment of a fuel injector for the combustor assembly shown in FIG. 2.
Figure 4:
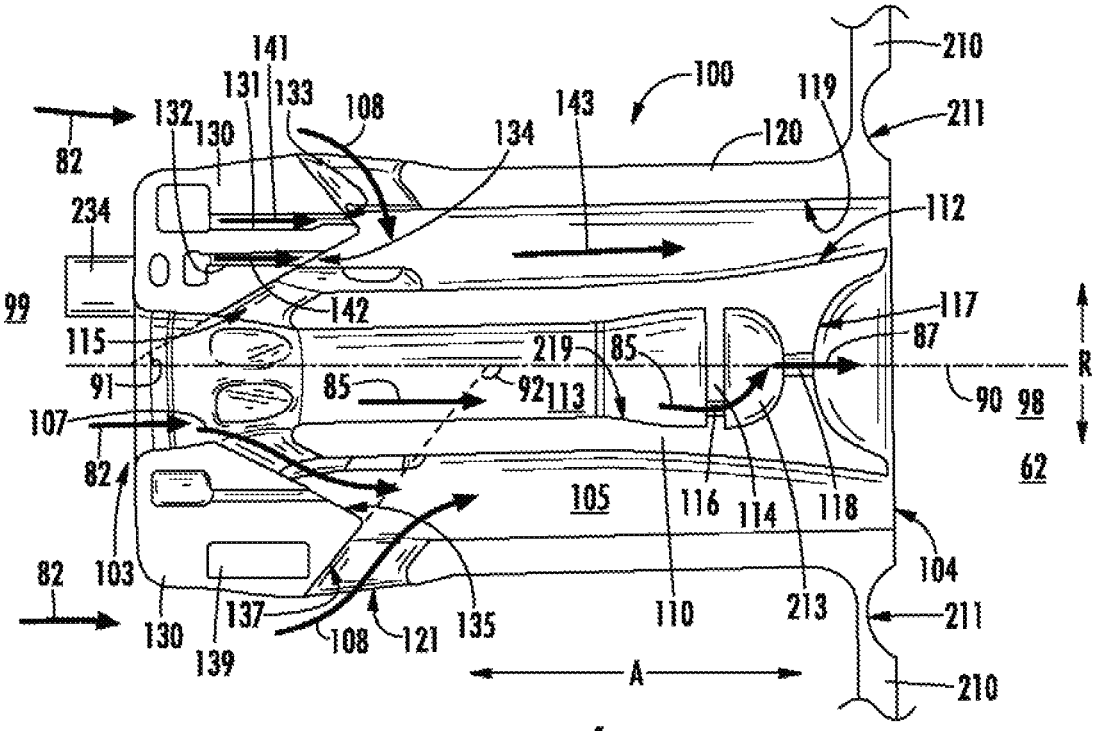
FIG. 4 is a cross sectional view of the exemplary embodiment of the fuel injector shown in FIG. 3.

Referring now to FIG. 3, a perspective view of an exemplary fuel injector 100 of the fuel nozzle 200 of the engine 10 of FIGS. 1-2 is generally provided. Referring also to FIG. 4, an axial cutaway view of the fuel nozzle 200 shown in FIG. 3 is generally provided. Referring to FIGS. 3-4, the fuel injector 100 includes a centerbody 110 defining an air inlet opening 115 defined substantially radially through the centerbody 110. The centerbody 110 is substantially hollow, such as to define a cooling cavity 113 extended along an axial direction A within the centerbody 110.

The fuel injector 100 further includes an outer sleeve 120 surrounding the centerbody 110. The outer sleeve 120 is extended circumferentially around the centerbody 110 and is extended along the axial direction A. In various embodiments, the outer sleeve 120 and the centerbody 110 are substantially concentric relative to one another and are further concentric relative to a fuel injector centerline 90 extended along the axial direction A therethrough for reference purposes. The outer sleeve 120 and the centerbody 110 together define a fuel-oxidizer mixing passage 105 extended along the axial direction A between the outer sleeve 120 and the centerbody 110. The outer sleeve 120 of the fuel injector 100 further defines a first air inlet port 121 defined outward from the air inlet opening 115 at the centerbody 110 along a radial direction R extended from the fuel injector centerline 90.

The fuel injector 100 further includes an end wall 130 coupled to the centerbody 110 and the outer sleeve 120. A first fuel injection port 131 is defined substantially along the axial direction A through the end wall 130 to the mixing passage 105. The first fuel injection port 131 defines a first fuel injection opening 133 at the mixing passage 105 between the first air inlet port 121 at the outer sleeve 120 and the air inlet opening 115 at the centerbody 110.

The end wall 130 defines a first forward face 135 extended at an acute angle relative to the fuel injector centerline 90 from the upstream end 99 to the downstream end 98. The first forward face 135 is defined at least partially through the air inlet opening 115 through the centerbody 110. As such, in various embodiments, the air inlet opening 115 is defined at least partially through the centerbody 110 and/or the end wall 130. In one embodiment, the first forward face 135 and the air inlet opening 115 together define an acute angle, depicted schematically at reference angle 91, between approximately 15 degrees and approximately 85 degrees (inclusively) relative to the fuel injector centerline 90. In another embodiment, the first forward face 135 and the air inlet opening 115 together define the acute angle 91 approximately 45 degrees, or up to approximately 40 degrees greater or approximately 30 degrees lesser. As such, the first forward face 135 and/or the air inlet opening 115 dispose a flow of compressed air, such as generally depicted by arrows 107, substantially along the angle 91 relative to the fuel injector centerline 90.

The end wall 130 further defines a second forward face 137 extended at an angle relative to the fuel injector centerline 90 from the first forward face 135 toward the upstream end 99. The second forward face 137 is defined at least partially through the air inlet port 121 defined through the outer sleeve 120. As such, in various embodiments, the air inlet port 121 is defined at least partially through the outer sleeve 120 and/or the end wall 130. In one embodiment, the second forward face 137 and the air inlet port 121 together define an angle, depicted schematically at reference angle 92, between approximately 95 degrees and approximately 165 degrees (inclusively) relative to the fuel injector centerline 90. In another embodiment, the second forward face 137 and/or the air inlet port 121 together define the angle 92 approximately 135 degrees, or up to approximately 30 degrees greater or approximately 40 degrees lesser. As such, the second forward face 137 and/or the air inlet port 121 dispose a flow of compressed air, such as generally depicted by arrows 108, substantially along the angle 92 relative to the fuel injector centerline 90.

In still various embodiments, the difference in the reference angle 91 of the first forward face 135 and the reference angle 92 of the second forward face 137 is between approximately 10 degrees and approximately 150 degrees (inclusively). In one embodiment, the difference in the reference angle 91 of the first forward face 135 and the reference angle 92 of the second forward face 137 is between approximately 60 degrees and approximately 120 degrees. As such, the forward faces 135, 137 of the end wall 130 may generally define a circular, elliptical, racetrack, conical or frusto-conical structure such as to mitigate formation of a low velocity region of the flow of air 107, 108 into the mixing passage 105, thereby mitigating flameholding and auto-ignition within the fuel injector 100. Additionally, or alternatively, the structure produced by the difference in reference angles 91, 92 may produce higher levels of turbulence of the air 107, 108 such as to substantially mitigate deposition of the fuel-air mixture 143 onto the centerbody 110 and outer sleeve 120 such as to maintain the fuel-air mixture 143 generally within the center of the mixing passage 105. As such, the angles 91, 92 of the forward faces 135, 137 of the end wall 130 may promote desired fuel-air mixing such as to reduce formations of oxides of nitrogen and mitigate fuel coking.

The end wall 130 further defines an upstream opening 103 at the upstream end 99 of the fuel injector 100 through which at least a portion of the flow of compressed air 82 is permitted to enter the fuel injector 100. During operation of the engine 10, such as described in regard to FIGS. 1-2, at least a portion of the flow of compressed air 82 entering the fuel injector 100 enters the mixing passage 105 via the air inlet opening 115, such as shown schematically by arrows 107. Another portion of the flow of compressed air 82, shown schematically by arrows 108, enters the mixing passage 105 via the air inlet port 121 defined through the outer sleeve 120. A first flow of liquid or gaseous fuel egresses from the first fuel injection port 131 into the mixing passage 105 via the first fuel injection opening 133, such as shown schematically by arrows 141. The radially opposing air inlet opening 115 and air inlet port 121 provide the air 107, 108 from radially outward and inward of the substantially axial flow of fuel 141 to generate a high turbulence, highly mixed fuel-air mixture at the mixing passage 105.

The high turbulence, highly mixed fuel-air mixture (shown schematically by arrows 143) is further mixed along the mixing passage 105 and egressed through a downstream opening 104 defined between the outer sleeve 120 and centerbody 110. The fuel-air mixture 143 is then ignited in the combustion chamber 62 to produce high energy, low emissions combustion gases 86 (FIGS. 1-2). The radially opposing air inlet port 121 and air inlet opening 115 may further produce an air blast atomizer effect that enables keeping fuel 141, 142 generally mid-radial span within the mixing passage 105 such as to prevent or mitigate "wetting" or deposition of fuel onto an inner surface 119 of the outer sleeve 120 or an outer surface 112 of the centerbody 110. As such, mitigating deposition of the fuel 141, 142 onto the inner surface 119 and outer surface 120 within the mixing passage 105 may mitigate fuel coking within the fuel injector 100.

In various embodiments, the fuel injector 100 further defines a second fuel injection port 132 through the end wall 130 in fluid communication with the mixing passage 105. The second fuel injection port 132 is defined substantially axially through the end wall 130, such as described in regard to the first fuel injection port 131. The second fuel injection port 132 is defined inward along the radial direction R relative to the first fuel injection port 131. In still various embodiments, the second fuel injection port 132 is defined radially between the first fuel injection port 131 and the air inlet opening 115 at the centerbody 110. The second fuel injection port 132 defines a second fuel injection opening 134 at a downstream end of the second fuel injection port 132 at the mixing passage 105. The second fuel injection opening 134 is defined substantially in between the air inlet opening 115 and the first air inlet port 121. Similarly as described in regard to the first fuel injection port 131, the second fuel injection port 132 provides a flow of fuel 142 through the second fuel injection opening 134 to the mixing passage 105 between radial inflows of air 107, 108 to produce a high turbulence, highly mixed fuel-air mixture 143. In various embodiments, the second fuel injection port 132 provides the second flow of fuel 142 in conjunction with the first flow of fuel 141 provided from the first fuel injection port 131. Various embodiments of the second fuel injection port 132 may be circumferentially aligned or offset relative to the first fuel injection port 131. Still various embodiments of the fuel injector 100 may variously define radial distances between the second fuel injection port 132 and the first fuel injection port 131.

Substantially axial injection of the fuel 141, 142 into the mixing passage 105 may improve fuel-air mixing across a plurality of fuel injection pressure ratios. For example, a pressure ratio between the egressing fuel 141, 142 versus a pressure within the mixing passage 105 generally alters based on an operating condition of the engine 10 (e.g., startup/ignition, idle or low power condition, part load or mid-power condition, full load or take-off or high power condition, etc.). Still further, the configuration of the air inlet opening 115 and air inlet port 121 relative to the fuel injection ports 131, 132 generally provide a relatively low- or no-swirl fuel-air mixture 143 into the mixing passage 105. Additionally, the substantially axial orientation of the fuel injection ports 131, 132 further facilitate inspection and cleaning, such as via observing whether the one or more of the fuel injection ports 131 132 is clogged, blocked, or otherwise obstructed when viewed from the downstream end 98 of the fuel injector 100.

Figure 5:
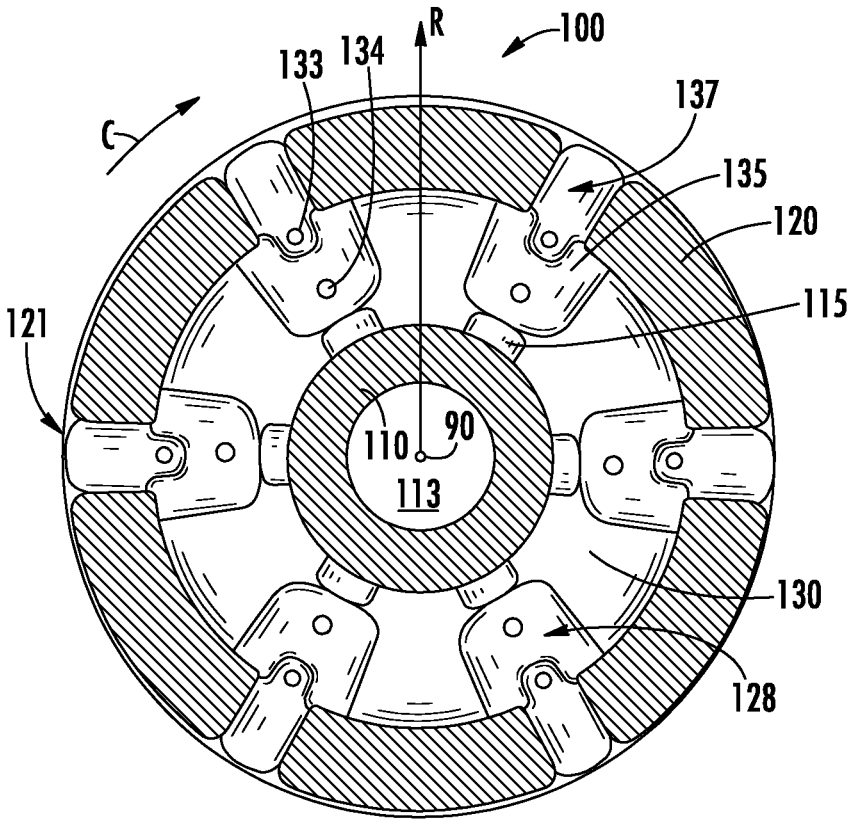
FIG. 5 is another cross sectional perspective view of the exemplary embodiment of the fuel injector shown in FIG. 3 along section 5-5.

Referring now to FIG. 5, an exemplary cross sectional view of the fuel injector 100 generally shown and described in regard to FIGS. 3-4 is provided along Section 5-5. As generally provided in FIG. 5, in various embodiments, the fuel injector 100 defines a plurality of the first air inlet port 121 through the outer sleeve 120 substantially in alignment along the radial direction R with the first fuel injection opening 133. In one embodiment, the fuel injector 100 further defines the first air inlet port 121 through the outer sleeve 120 substantially in radial alignment with the first fuel injection opening 133 and the second fuel injection opening 134. In another embodiment, the fuel injector 100 further defines the first air inlet port 121 through the outer sleeve 120, the air inlet opening 115 through the centerbody 110, and one or more of the first fuel injection opening 133 or second fuel injection opening 134 substantially in radial alignment with one another. As such, one or more of the flows of fuel 141, 142 may flow into the mixing passage 105 (FIGS. 3-4) radially between the flows of air 107, 108 entering the mixing passage 105 through the first air inlet port 121 and air inlet opening 115.

Referring still to FIG. 5, in conjunction with FIGS. 3-4, the end wall 130 further defines a substantially conical portion 128 surrounding each fuel injection opening 133, 134. In various embodiments, the conical portion 128 of the end wall 130 is formed at least partially of the first forward face 135. In still various embodiments, the conical portion 128 is further formed at least partially of the second forward face 137. The conical portion 128 may generally define an at least partially conical volume extended substantially along the axial direction A. The conical portion 128 may further be defined substantially frusto-conical, such as to define a substantially flat or tapered downstream end, such as where one or more of the fuel injection openings 133, 134 may be disposed. The conical portion 128 of the end wall 130 may generally mitigate formation of a low velocity region of the flow of air 107, 108 into the mixing passage 105, thereby mitigating flameholding and auto-ignition within the fuel injector 100.

Referring back to FIG. 4, in various embodiments, the centerbody 110 further defines a first inner radial wall 114 extended radially within the centerbody 110. The first inner radial wall 114 defines an impingement opening 116 extended at least partially along the axial direction A through the first inner radial wall 114. The first inner radial wall 114 further defines a second cooling cavity 213.

The second cooling cavity 213 is further defined between the first inner radial wall 114 and between a second inner radial wall 117 extended along the radial direction R inward of the outer surface 112 of the centerbody 110. In various embodiments, the second inner radial wall 117 is defined downstream along the axial direction A of the first inner radial wall 114. The second inner radial wall 117 is defined adjacent to the combustion chamber 62. In one embodiment, the second inner radial wall 117 is defined protruded along the axial direction A toward the upstream end 99 of the fuel injector 100. As such, a radially inward portion of the centerbody 110, such as inward of the outer surface 112 of the centerbody 110, is defined concave along the axial direction A away from the combustion chamber 62. In still various embodiments, the second inner radial wall 117 defines a cooling opening 118 extended at least partially along the axial direction A through the second inner radial wall 117. The cooling opening 118 is defined adjacent to the second cooling cavity 213 and the combustion chamber 62.

During operation of the engine 10, a portion of the flow of compressed air 82 enters the cooling cavity 113 within the centerbody 110, such as shown schematically by arrows 83. The impingement opening 116 permits flow of compressed air through the first inner radial wall 114, such as shown schematically by arrows 85. The flow of compressed air 85 through the first inner radial wall 114 into the second cooling cavity 213 then flows through the second inner radial wall 117 into the combustion chamber 62 via the cooling opening 118, such as shown schematically by arrows 87. The first inner radial wall 114 defining the impingement opening 116 therethrough and the second inner radial wall 117 together defining the second cooling cavity 213 enable a relative higher heat transfer coefficient at the upstream end of the second inner radial wall 117 (i.e., at the second cooling cavity 213), such as to promote cooling of the centerbody 110 at a relatively hotter downstream end proximate to the combustion chamber 62.

In various embodiments, the impingement opening 116 is defined through the first inner radial wall 114 outward along the radial direction R proximate to an inner surface 219 of the centerbody 110 within the cooling cavity 113. For example, the first inner radial wall 114 may be extended radially and circumferentially within the centerbody 110 from the fuel injector centerline 90 to the inner surface 219 of the centerbody 110. In one embodiment, the impingement opening 116 may be defined within about 50% of a span from the inner surface 219 toward the fuel injector centerline 90 (i.e., within approximately 50% of a distance along the first inner radial wall 114 from the inner surface 219 to the fuel injector centerline 90). In another embodiment, the impingement opening 116 may be defined within about 30% of a span from the inner surface 219 to the fuel injector centerline 90. In still another embodiment, the impingement opening 116 may be defined within about 10% of a span from the inner surface 219 to the fuel injector centerline 90. As such, the impingement opening 116 may promote heat transfer along the radially outer surfaces of the centerbody 110, such as along the inner surface 219 and the outer surface 119, that may generally be exposed to higher temperatures from the combustion chamber 62.

In still various embodiments, the cooling opening 118 through the second inner radial wall 117 is defined substantially concentric to the fuel injector centerline 90 such as to promote cooling in conjunction with the concaving protrusion of the second inner radial wall 117. Still further, the cooling opening 118 therethrough promotes higher heat transfer such as to improve cooling of the upstream end of the centerbody 110, such as the second inner radial wall 117. As such, the cooling opening 118 may enable the engine 10 to operate at higher temperatures, including use of liquid fuel, gaseous fuel, or combinations thereof.

Referring still to FIGS. 3-4, in various embodiments the fuel injector 100 may further define a second air inlet port 122 through the outer sleeve 120 or end wall 130 upstream of the first air inlet port 121. In one embodiment, the second air inlet port 122 is disposed circumferentially between a plurality of first fuel injection ports 131 defined in adjacent circumferential arrangement through the end wall 130. In still various embodiments, the outer sleeve 120 further defines an air cavity 139 disposed radially outward of the first fuel injection port 131. During operation of the engine 10, a portion of the flow of compressed air 82 is provided to the air cavity 139 via the second air inlet port 122, such as shown schematically by arrows 106. The flow of air 106 into the air cavity 139 via the second air inlet port 122 generally surrounds the first fuel injection ports 131 such as to provide sufficient cooling to the fuel flowing therethrough. For example, the flow of air 106 provided to the air cavity 139 may provide insulation such as to mitigate fuel coking in the first fuel injection port 131. As such, the air cavity 139 may further improve durability of the fuel injector 100.

Figure 6:
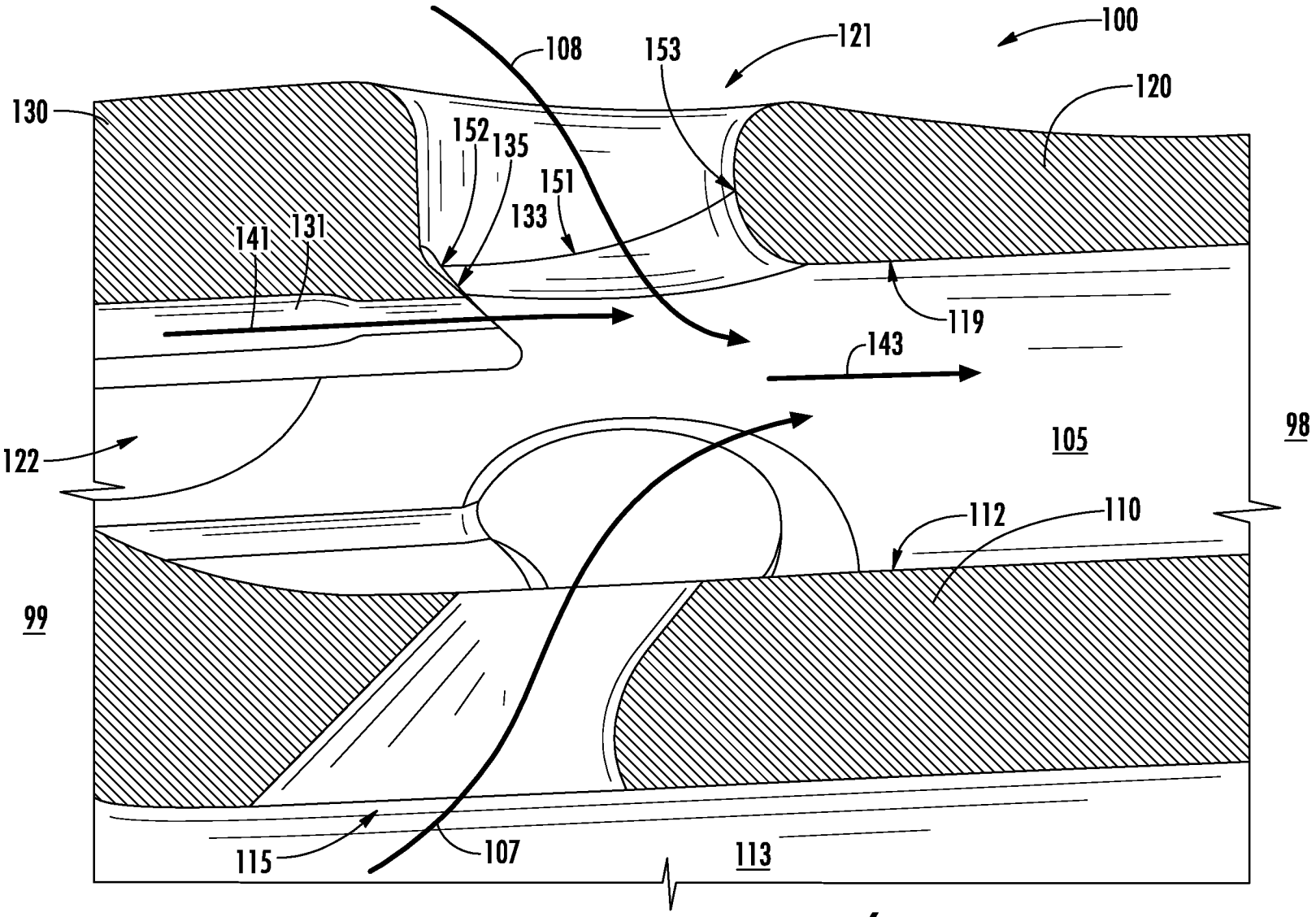
FIG. 6 is a perspective cutaway view of an exemplary embodiment of a fuel injector shown in FIG. 2.

Referring now to FIG. 6, a perspective cutaway view of another exemplary embodiment of the fuel injector 100 is generally provided. In various embodiments, the fuel injector 100 may further define a variable fillet 151 extended from a forward end 152 to an aft end 153 within one or more of the first air inlet port 121 (e.g., shown in regard to FIG. 6), the second air inlet port 122, the air inlet opening 115, or combinations thereof. In one embodiment, the variable fillet 151 is defined at the air inlet ports 121, 122 or air inlet opening 115 adjacent to the mixing passage 105. In another embodiment, the variable fillet 151 is defined at the air inlet ports 121, 122 at the first forward face 135 and through the outer sleeve 120.

In various embodiments, the variable fillet 151 defines a radius at the aft end 153 approximately nine times greater than the forward end 152. In other embodiments, the variable fillet 151 defines a radius at the aft end 153 approximately seven times greater than the forward end 152. In still other embodiments, the variable fillet 151 defines a radius at the aft end 153 approximately five times greater than the forward end 152. In still yet various embodiments, the variable fillet 151 defines a radius at the aft end 153 greater than one times the forward end 152 and less than or equal to nine times the forward end 152.

The variable fillet 151 may reduce re-circulation of the fuel-air mixture 143 within the mixing passage 105 by mitigating flow attachment to the outer sleeve 120. More specifically, the variable fillet 151 may increase a velocity of the flow of air 106, 107, 108 into the mixing passage 105. The increased velocity of the flow of air mixes with the flow of fuel 141, 142 to mitigate flow attachment to the outer sleeve 120. Furthermore, or alternatively, the variable fillet 151 may further reduce "wetting" or deposition of fuel onto the outer surface 112 of the centerbody 110 and/or the inner surface 119 of the outer sleeve 120. For example, the flows of air 107, 108 entering the mixing passage 105 define layers radially outward and inward of the flow of fuel 141, 142 to mitigate fuel deposition or wetting on the surfaces 112, 119. Still further, or alternatively, the variable fillet 151 may increase the velocity of flow of air entering into the mixing passage 105 such as to mitigate auto-ignition of flameholding within the fuel injector 100.

Figure 7:
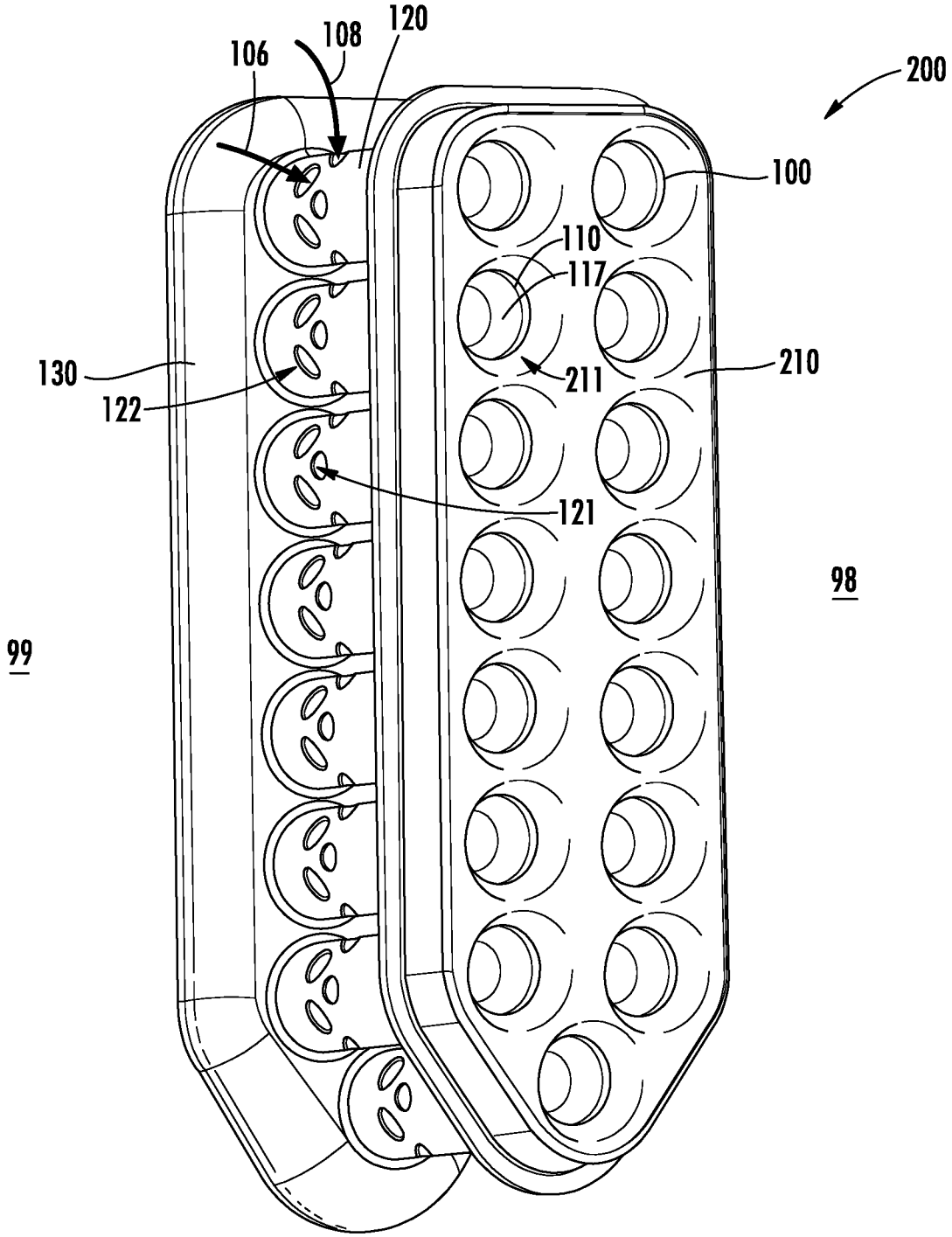
FIG. 7 is a perspective view of an exemplary fuel nozzle including a plurality of the exemplary fuel injectors shown in FIG. 2.
Figure 8:
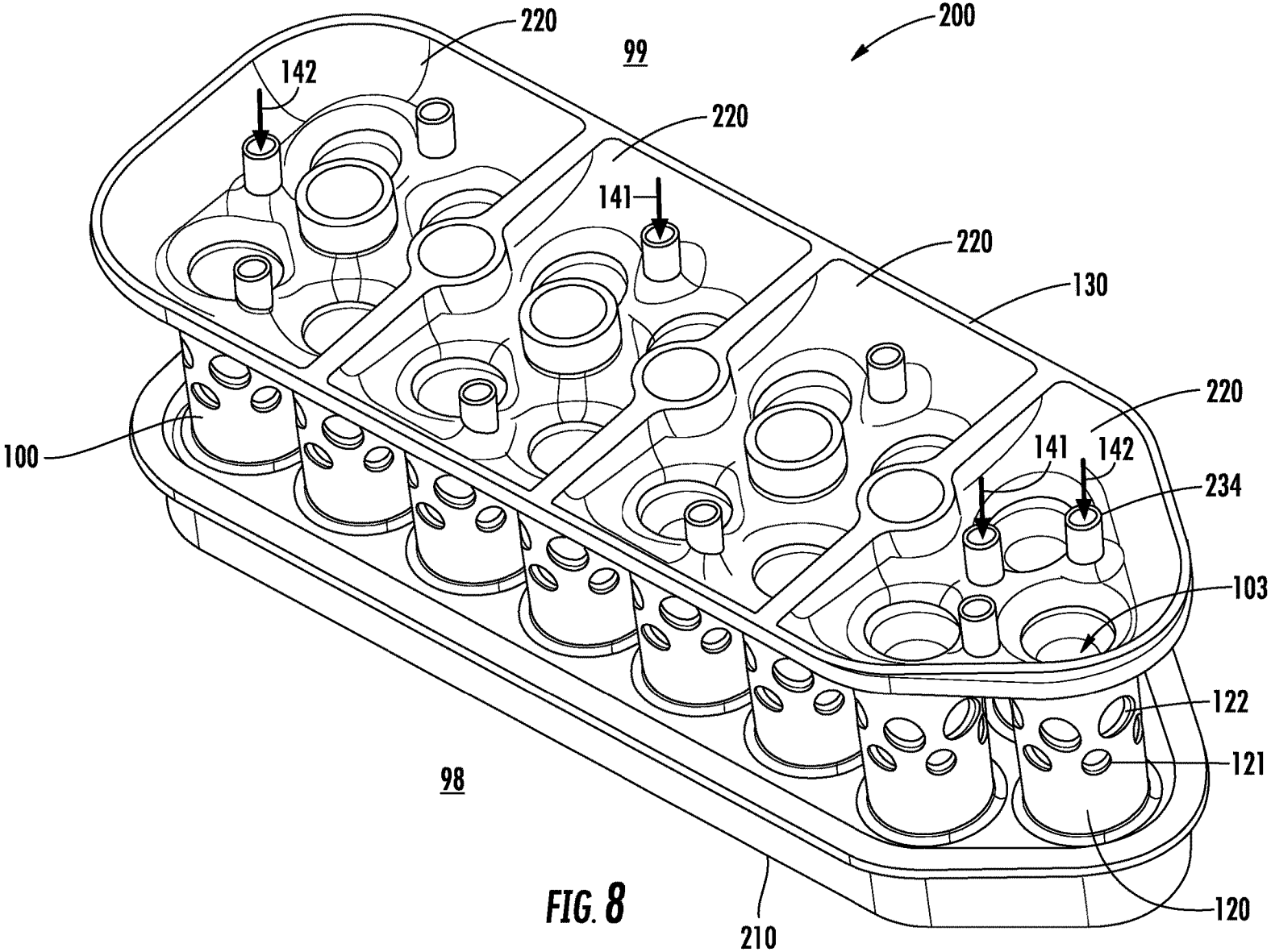
FIG. 8 is a cutaway perspective view of the end wall of the exemplary fuel nozzle shown in FIG. 7.

Referring now to FIG. 7, a perspective view of an exemplary embodiment of a fuel nozzle 200 is shown. Referring further to FIG. 8, a cutaway view of the fuel nozzle 200 of FIG. 7 is generally provided. Referring to FIGS. 6-7, the fuel nozzle 200 includes the end wall 130, a plurality of fuel injectors 100, and an aft wall 210. The plurality of fuel injectors 100 may be configured in substantially the same manner as described in regard to FIGS. 3-5. However, the aft wall 210 is connected to the downstream end 98 of the outer sleeve 120 of each of the plurality of fuel injectors 100. Furthermore, the end wall 130 of the fuel nozzle 200 defines at least one fuel plenum 234 each in fluid communication with the plurality of fuel injectors 100. The fuel plenum 234 defines a passage through which one or more flows of fuel 141, 142 are provided to the fuel injection ports 131, 132 of each fuel injector 100.

Referring to FIG. 7 in conjunction with FIG. 4, the aft wall 210 coupled to the outer sleeve 120 further defines a groove 211 substantially concentric to the fuel injector centerline 90 of each fuel injector 100. In one embodiment, the groove 211 is defined substantially semi-circular along the axial direction A into the aft wall 210. In various embodiments, the groove 211 is defined concave along the axial direction A away from the combustion chamber 62, such as shown and described in regard to the second radial inner wall 117. The groove 211 defined into the aft wall 210 may further improve flame stabilization from the exiting fuel-air mixture 143.

Referring now to FIG. 8, a cutaway perspective view of the end wall 130 of the exemplary embodiment of the fuel nozzle 200 of FIG. 7 is shown. FIG. 8 shows a cutaway view of the end wall 130 and a plurality of fuel plenums 234. The fuel nozzle 200 may define a plurality of independent fluid zones 220 to independently and variably articulate a fluid into each fuel plenum 234 for each fuel nozzle 200 or plurality of fuel nozzles 200 within the combustor assembly 50. Independent and variable controllability includes setting and producing fluid pressures, temperatures, flow rates, and fluid types through each fuel plenum 234 separate from another fuel plenum 234.

In the embodiment shown in FIG. 8, each independent fluid zone 220 may define separate fluids, fluid pressures and flow rates, and temperatures for the fluid through each fuel injector 100. Additionally, in another embodiment, the independent fluid zones 220 may define different fuel injector 100 structures within each independent fluid zone 220. For example, the fuel injector 100 in a first independent fluid zone 220 may define different radii or diameters from a second independent fluid zone 220 within the first and second air inlet ports 121, 122, the air inlet opening 115, the fuel injection ports 131, 132, or the mixing passage 105. As another non-limiting example, a first independent fluid zone 220 may define features within the fuel injector 100, including the fuel plenum 234, that may be suitable as a pilot fuel injector, or as an injector suitable for altitude light off (i.e. at altitudes from sea level up to about 16200 meters). As still another example, a second independent fluid zone 220 may define features within the fuel injector 100 that may be suitable as a main fuel injector (e.g., mid-power or part load condition, high-power or full load condition, etc.).

The independent fluid zones 220 may further enable finer combustor tuning by providing independent control of fluid pressure, flow, and temperature through each plurality of fuel injectors 100 within each independent fluid zone 220. Finer combustor tuning may further mitigate undesirable combustor tones (i.e. thermo-acoustic noise due to unsteady or oscillating pressure dynamics during fuel-air combustion) by adjusting the pressure, flow, or temperature of the fluid through each plurality of fuel injectors 100 within each independent fluid zone 220. Similarly, finer combustor tuning may prevent LBO, promote altitude light off, and reduce hot spots (i.e. asymmetric differences in temperature across the circumference of a combustor that may advance turbine section deterioration). While finer combustor tuning is enabled by the magnitude of the plurality of fuel injectors 100, it is further enabled by providing independent fluid zones 220 across the radial distance of a single fuel nozzle 200 (or, e.g. providing independent fluid zones 220 across the radial distance of the combustor assembly 50). Still further, the independent fluid zones 220 may differ radially or, in other embodiments, circumferentially, or a combination of radially and circumferentially. In contrast, combustor tuning is often limited to adjusting the fuel at a fuel nozzle at a circumferential location or sector rather than providing radial and/or circumferential adjustment.

In various embodiments, the fuel nozzle 200 may define one or more combinations of lean burn and relatively richer burning arrangements of fuel injectors 100. For example, the fuel nozzle 200 may define a plurality of lean burn fuel injectors surrounding a relatively richer burning fuel injector. In one embodiment, the fuel nozzle 200 may define two lean burn fuel injectors for each relatively richer burning fuel injector. In another embodiment, the fuel nozzle 200 may define three or more lean burn fuel injectors for each relatively richer burning fuel injector. In still another embodiment, the fuel nozzle 200 may define six or more lean burn fuel injectors for each relatively richer burning fuel injector. In still yet another embodiment, the fuel nozzle 200 may define one hundred or fewer lean burn fuel injectors for each relatively richer burning fuel injector. In still yet other embodiments, the plurality of fuel injectors 100 may each be defined as lean burning.

It should be appreciated that "lean" as used herein is generally defined relative to air-fuel equivalence ratios λ greater than 1.0

$$\lambda = \frac{\text{actual air} - \text{fuel ratio}}{\text{stoichiometric air} - \text{fuel ratio}}$$

Furthermore, "rich" or "richer" as used herein is generally defined as an air-fuel equivalence ratio less than the lean air-fuel equivalence ratio of another fuel injector 100 coupled to the fuel nozzle 200. As such, "rich" or "richer" as used herein may include lean air-fuel equivalence ratios less than a maximum magnitude lean burning configuration of one or more fuel injectors and greater than 1.0 (i.e., $\lambda>1.0$). Still further, "rich" or "richer" as used herein may include rich air-fuel equivalence ratios less than 1.0 (i.e., $\lambda<1.0$).

Openings, ports, orifices, and holes shown and described herein may be defined as substantially circular, elliptical, racetrack (i.e., opposing half-circle radii separated by an axially elongated mid-section), polygonal, or oblong cross sections. For example, referring to FIGS. 2-5 of the exemplary embodiments of the fuel injector 100, the air inlet ports 121, 122 and/or the air inlet opening 115 may each define a substantially racetrack cross sectional area (such as generally shown) that my prevent liquid fuel from the fuel injection ports 131, 132 from "wetting" or otherwise substantially depositing liquid fuel onto the inner surface 119 of the outer sleeve 120 and/or the outer surface 112 of the centerbody 110, such as to mitigate or eliminate fuel coking within the mixing passage 105. In other embodiments, the air inlet ports 121, 122, the air inlet openings 115, the fuel injection ports 131, 132, the fuel injection openings 133, 134, or combinations thereof, may each define a substantially circular, elliptical, racetrack, polygonal, or oblong cross section.

The fuel injector 100, fuel nozzle 200, and combustor assembly 50 shown in FIGS. 1-8 and described herein may be constructed as an assembly of various components that are mechanically joined or as a single, unitary component and manufactured from any number of processes commonly known by one skilled in the art. These manufacturing processes include, but are not limited to, those referred to as "additive manufacturing" or 3D printing". Additionally, any number of casting, machining, welding, brazing, or sintering processes, or mechanical fasteners, or any combination thereof, may be utilized to construct the fuel injector 100, the fuel nozzle 200, or the combustor assembly 50. Furthermore, the fuel injector 100 and the fuel nozzle 200 may be constructed of any suitable material for turbine engine combustor sections, including but not limited to, nickel- and cobalt-based alloys. Still further, flowpath surfaces, such as, but not limited to, the fuel injection ports 131, 132, the inner surface 119 of the outer sleeve 120, the outer surface 112 of the centerbody 110, the air inlet openings 115, the air inlet ports 121, 122, or combinations thereof may include surface finishing or other manufacturing methods to reduce drag or otherwise promote fluid flow or mitigate fuel wetting onto one or more of the surfaces. Such surface finishing may include, but is not limited to, tumble finishing, barreling, rifling, polishing, or coating.

The plurality of fuel injectors 100 disposed in adjacent radial or circumferential arrangement per fuel nozzle 200 may produce a plurality of well-mixed, compact non-swirl or low-swirl flames at the combustion chamber 62 with higher energy output while maintaining or decreasing emissions. The plurality of fuel injectors 100 in the fuel nozzle 200 producing a more compact flame and mitigating strong-swirl stabilization may further mitigate combustor tones caused by vortex breakdown or unsteady processing vortex of the flame. Additionally, the plurality of independent fluid zones may further mitigate combustor tones, LBO, and hot spots while promoting higher energy output, lower emissions, altitude light off, and finer combustion controllability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel injector for a gas turbine engine defining a fuel injector centerline axis and having an axially forward end, with respect to the fuel injector centerline axis, and having an axially aft end, with respect to the fuel injector centerline axis, the fuel injector comprising:

a centerbody defining an air inlet opening defined substantially radially, relative to the fuel injector centerline axis, through the centerbody;

an outer sleeve surrounding the centerbody, wherein the outer sleeve defines a radially oriented first air inlet port defined radially outward, with respect to the fuel injector centerline axis, of the air inlet opening at the centerbody, and further wherein a mixing passage is defined between the outer sleeve and the centerbody; and an end wall coupled to the centerbody and the outer sleeve and positioned at the axially forward end, wherein a first fuel injection port is defined substantially axially, along the fuel injector centerline axis, through the end wall to the mixing passage, wherein the first fuel injection port defines a first fuel injection opening at the mixing passage between the radially oriented first air inlet port at the outer sleeve and the air inlet opening at the centerbody, wherein a first forward face defines a part of the air inlet opening, wherein a second forward face defines a part of the radially oriented first air inlet port, wherein the first forward face and the second forward face are defined by the end wall and meet at a meeting portion aft of the first and second forward faces; and wherein the meeting portion is positioned axially aft, along the fuel injector centerline axis, of the air inlet opening.

2. The fuel injector of claim 1, wherein the centerbody defines a substantially hollow cooling cavity, and wherein a flow of oxidizer is permitted to flow therethrough.

3. The fuel injector of claim 2, wherein the centerbody defines a first inner radial wall extended radially, with respect to the fuel injector centerline axis, within the centerbody, and wherein the first inner radial wall defines an impingement opening therethrough to permit the flow of oxidizer through the first inner radial wall.

4. The fuel injector of claim 2, wherein the centerbody defines a second inner radial wall extended radially, with respect to the fuel injector centerline axis, within the centerbody, and wherein the second inner radial wall defines a cooling opening therethrough.

5. The fuel injector of claim 4, wherein the second inner radial wall extends axially along the fuel injector centerline axis toward the forward end of the fuel injector.

6. The fuel injector of claim 1, wherein the first forward face defines an acute angle relative to the fuel injector centerline axis.

7. The fuel injector of claim 1, wherein the first forward face and the air inlet opening together define an acute angle between 15 degrees and 85 degrees relative to the fuel injector centerline axis.

8. The fuel injector of claim 1, wherein the outer sleeve further defines a second air inlet port positioned axially forward, along the fuel injector centerline axis, of the radially oriented first air inlet port.

9. The fuel injector of claim 1, wherein the outer sleeve is coupled to an aft wall defining a groove substantially concentric to the fuel injector centerline axis.

10. The fuel injector of claim 1, wherein a second fuel injection port is defined through the end wall radially inward, relative to the fuel injector centerline axis, of the first fuel injection port, and wherein the second fuel injection port is defined substantially axially, along the fuel injector centerline axis, through the end wall to the mixing passage.

11. The fuel injector of claim 10, wherein the second fuel injection port is defined radially, relative to the fuel injector centerline axis, between the first fuel injection port and the air inlet opening.

12. The fuel injector of claim 1, wherein the second forward face and the radially oriented first air inlet port together define an angle between 95 degrees and 165 degrees relative to the fuel injector centerline axis.

13. The fuel injector of claim 1, wherein the radially oriented first air inlet port is defined through the outer sleeve substantially in circumferential alignment with the first fuel injection opening.

14. The fuel injector of claim 1, wherein the end wall further defines a substantially conical portion surrounding each first fuel injection port.

15. The fuel injector of claim 14, wherein the substantially conical portion of the end wall further surrounds a second fuel injection port defined through the end wall.

16. The fuel injector of claim 1, wherein the outer sleeve further defines an air cavity disposed radially outward, relative to the fuel injector centerline axis of the first fuel injection port.

17. A fuel injector for a gas turbine engine, the fuel injector defining a fuel injector centerline axis and having an axially forward end, with respect to the fuel injector centerline axis, and having an axially aft end, with respect to the fuel injector centerline axis, the fuel injector comprising:

a centerbody defining an air inlet opening defined substantially radially, relative to the fuel injector centerline axis, through the centerbody;

an outer sleeve surrounding the centerbody, wherein the outer sleeve defines a radially oriented first air inlet port defined radially outward, relative to the fuel injector centerline axis, of the air inlet opening at the centerbody, and further wherein a mixing passage is defined between the outer sleeve and the centerbody; and an end wall coupled to the centerbody and the outer sleeve and positioned at the axially forward end, wherein a first fuel injection port is defined substantially axially, along the fuel injector centerline axis, through the end wall to the mixing passage, wherein the first fuel injection port defines a first fuel injection opening at the mixing passage between the radially oriented first air inlet port at the outer sleeve and the air inlet opening at the centerbody, wherein a first forward face defines a part of the air inlet opening, wherein a second forward face defines a part of the radially oriented first air inlet port, wherein the end wall defines the first and second forward faces, and wherein the first and second forward faces overlap each other in a radial direction of the fuel injector, and an outlet of the air inlet opening and an outlet of the radially oriented first air inlet port at least partially overlap each other in the radial direction of the fuel injector.

18. The fuel injector of claim 17, wherein a variable fillet is defined within one or more of the radially oriented first air inlet port, a second air inlet port or the air inlet opening, wherein the variable fillet comprises a forward end and an aft end.

* * * * *